US005641155A

United States Patent [19]

Bridges

[11] Patent Number: 5,641,155

[45] Date of Patent: Jun. 24, 1997

[54] COMPENSATING PREFEEDER GATE AND METHOD

[75] Inventor: Jimmy R. Bridges, Charlotte, N.C.

[73] Assignee: Roberts Systems, Inc., Charlotte, N.C.

[21] Appl. No.: 476,895

[22] Filed: Jun. 7, 1995

[51] Int. Cl.[6] ..... B65H 3/04

[52] U.S. Cl. ..... 271/35; 271/125

[58] Field of Search ..... 271/150, 151, 271/124, 125, 35, 6

[56] References Cited

U.S. PATENT DOCUMENTS

| | | | |
|---|---|---|---|
| 1,019,158 | 3/1912 | Ielfield . | |
| 1,515,986 | 11/1924 | Wright et al. . | |
| 1,932,506 | 10/1933 | Brackett et al. | 271/35 |
| 1,948,362 | 2/1934 | Staude | 271/35 |
| 2,635,874 | 4/1953 | La Bore | 271/35 |
| 2,639,916 | 5/1953 | Anness | 271/35 |
| 3,262,697 | 7/1966 | Krinke | 271/35 |
| 3,941,373 | 3/1976 | Stange . | |
| 3,991,998 | 11/1976 | Banz et al. . | |
| 4,062,532 | 12/1977 | Peter et al. . | |
| 4,546,963 | 10/1985 | Dinnissen . | |
| 4,606,535 | 8/1986 | Larson . | |
| 4,666,141 | 5/1987 | Labombarde | 271/35 |
| 4,771,896 | 9/1988 | Newsome . | |
| 4,961,566 | 10/1990 | Labombarde . | |
| 5,301,834 | 4/1994 | Lee et al. . | |

FOREIGN PATENT DOCUMENTS

| | | | |
|---|---|---|---|
| 1068162 | 6/1954 | France | 271/35 |
| 507460 | 3/1976 | U.S.S.R. | 271/35 |

*Primary Examiner*—H. Grant Skaggs
*Attorney, Agent, or Firm*—Hardaway Law Firm PA

[57] ABSTRACT

A prefeeder gate (10) is comprised of an elongated arm (12) extending outwardly at different points to form a first seat (14) and a second seat (16) having a lower portion (16*a*) and an upper portion (16*b*), nip rollers (17) attached to an operative end of the arm, a first shaft (18) received in the first seat and in the lower portion of the second seat, a body (20) having at one end a threaded bore (24) formed therein and having a frame attachment assembly (22) another end, a second shaft (42) having a first externally threaded end and a second end, the second shaft journaled in the upper portion of the second seat, the first externally threaded end being threadably received in the threaded bore, a nip adjustment knob (44) received on the second end of the second shaft, a spring (48) coiled around the second shaft intermediate the second seat and the nip adjustment knob, and slide bearings (56, 58) interconnecting the body and the first shaft, the slide bearings being adapted to slide along a length of the first shaft. The nip rollers are thereby vertically displaceable with respect to the body responsive to thickness of conveyed articles contacted by the nip rollers, making the prefeeder gate a floating, compensating gate adapted to convert a stack of a plurality of articles into a uniform shingled arrangement of such articles, regardless of the size and weight of the stack.

10 Claims, 9 Drawing Sheets

COMPENSATING PREFEEDER GATE AND METHOD

BACKGROUND OF THE INVENTION

This invention is directed toward a gate for a prefeeder which is designed to take a stack of substantially flat articles and provide them in a desired shingled arrangement for further processing.

It is oftentimes difficult to maintain the proper shingled relationship throughout a continuous operation of the prefeeder. Variations in the height of the stacked signatures provided to the prefeeder, which necessarily translates into variations in the weight of the stack and the magnitude of the compressive force acting upon each article in the stack, adversely affects the quality of the resulting shingle. Such problems are intensified with respect to smaller size blanks or signatures.

Examples of prior art prefeeder gates can be found in U.S. Pat. No. 4,062,532 to Peter, et al. and U.S. Pat. No. 4,771,896 to Newsome, these two references being incorporated herein by reference. Such prior art devices employ a control gate having an adjustable-height throat which regulates the number of blanks passing through the gate and thereby controlling the degree of shingling of the blanks. By controlling the degree of shingling, faster and more efficient processing of the resulting shingled articles is possible. The effectiveness of such prior art structures in inducing proper shingling, however, diminishes as the size of the conveyed articles decreases.

Floating gates in general are known in the art for the purpose of admitting only one sheet or article in a stack at a time, as opposed to a plurality of articles in a shingled arrangement. For instance, U.S. Pat. No. 4,961,566 to Labombarde (deceased) discloses a sheet feeder including a spring-biased gate, the lower end of which is disposed above the conveying surface by a predetermined distance. In operation, a sheet lifter causes the gate to rise along with the stack of sheets lifted. A single sheet is admitted through the gate only after the sheet lifter, and thus the stack of sheets, have been completely lowered. For further example, U.S. Pat. No. 3,941,373 to Stange discloses a floating sheet separator biased upwardly by a spring into contact with an upper belt. The force of the spring prevents admission of more than one sheet at a time. While such devices may be suitable for their respective intended purposes, they are not suited to admit multiple articles at one time, e.g., articles conveyed in a shingled arrangement. Accordingly, there is room for improvement within the art.

SUMMARY OF THE INVENTION

It is thus an object of the present invention to provide an improved apparatus and process for arranging a stack of conveyed articles in a shingled configuration.

It is still a further and more particular object of this invention to provide an improved gate for a prefeeder which is compensating in response to the characteristics of the stock material passing through the gate.

It is still a further and more particular object of this invention to provide a prefeeder gate in which the throat distance continuously fluctuates in response to the passage of conveyed articles through the throat. It is a more particular aspect of the present invention to provide a gate for prefeeder in which the bottom nip roller floats in a vertical direction relative to the associated conveyor apparatus positioned below the nip roller.

It is still a further and more particular object of this invention to provide a compensating prefeeder gate which provides for a uniform shingling of stacked conveyed articles, such as carton stock, regardless of variations in the weight and height of the stack.

These and other objects are accomplished by a compensating prefeeder gate, comprising an elongated arm extending outwardly at one point along its length to form a first seat and extending outwardly at another point along its length to form a second seat, the second seat having a lower portion and an upper portion, a first shaft received in the first seat and in the lower portion of the second seat, a body having at one end a threaded bore formed therein and having at another end a frame attachment assembly, a second shaft having a first externally threaded end and a second end, the second shaft journaled in the upper portion of the second seat, the first externally threaded end being threadably received in the threaded bore, a nip adjustment knob received on the second end of the second shaft, a spring coiled around the second shaft intermediate the second seat and the nip adjustment knob, a slide bearing interconnecting the body and the first shaft, the slide bearing being adapted to slide along a length of the first shaft, and a nip roller attached to an operative end of the arm. The nip roller is thereby vertically displaceable with respect to the body responsive to thickness of conveyed articles contacted by the nip roller.

The compensating prefeeder gate of the present invention facilitates an improved process for shingling a stack of cartons or similar signature items and represents an improvement and a simplification over prior art prefeeder gates and gate control teachings. By allowing the gate to self-adjust along its vertical axis, the conveyed stack of articles will engage the nip roller and lift the nip roller, permitting a plurality of articles to pass through the gate. Simultaneously, as the gate presses down on the conveyed articles, the uppermost articles relative to the nip roller are progressively retarded, thereby imparting a shingled arrangement to the passage of the carton stock material. It has been surprisingly found that the invention imparts a uniform shingled arrangement irrespective of the size or weight of the stack of conveyed material. This contrasts with prior art devices, which essentially require a constant weight and height of conveyed articles for effective shingling.

DETAILED DESCRIPTION OF THE PREFERRED EMBODIMENT

Figure 1:
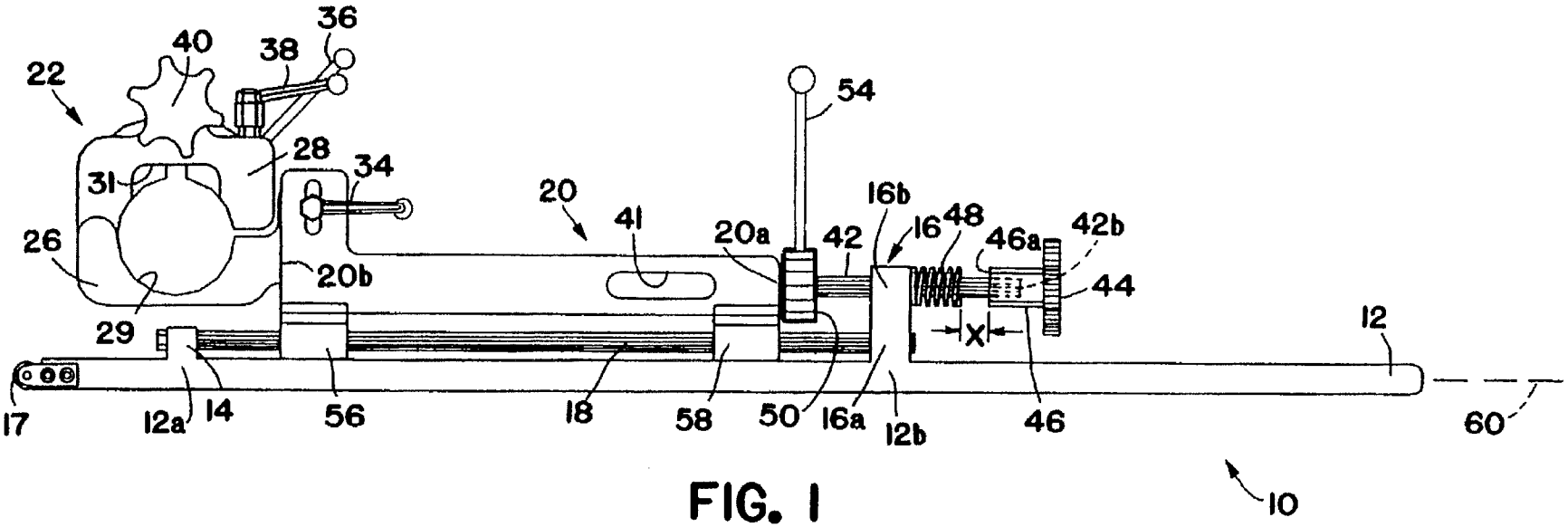
FIG. 1 is a side elevation view of a compensating prefeeder gate constructed in accordance with a preferred embodiment of the present invention.
Figure 2:
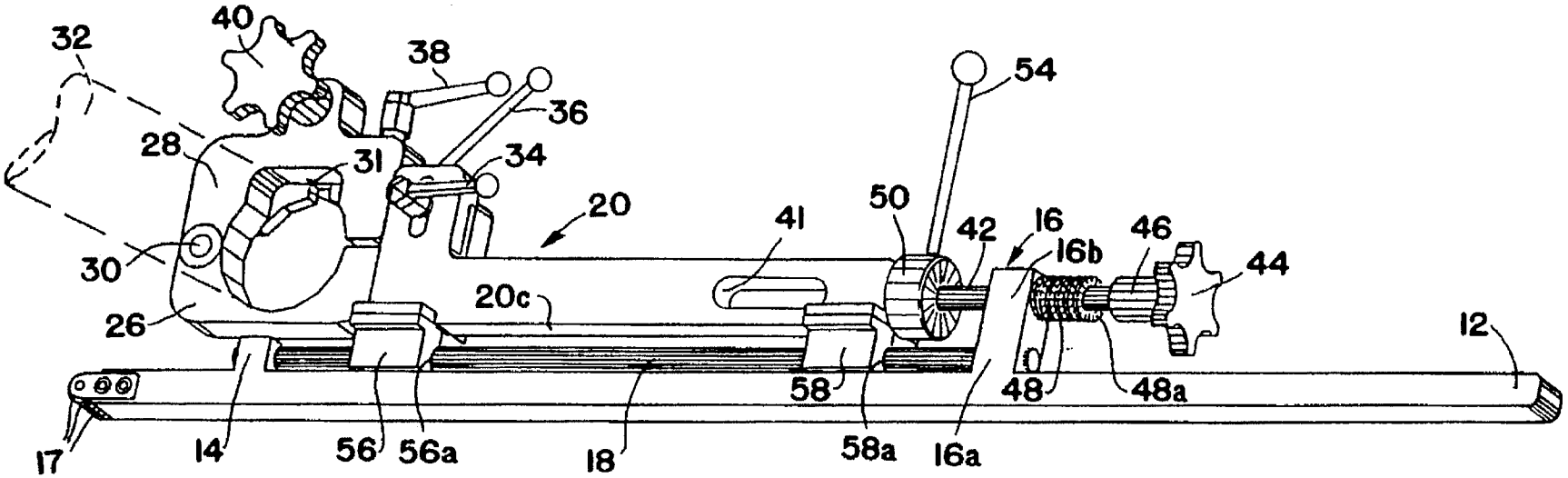
FIG. 2 is a perspective view of the compensating prefeeder gate constructed in accordance the preferred embodiment of the present invention, shown in relation to a machine frame member.
Figure 3:
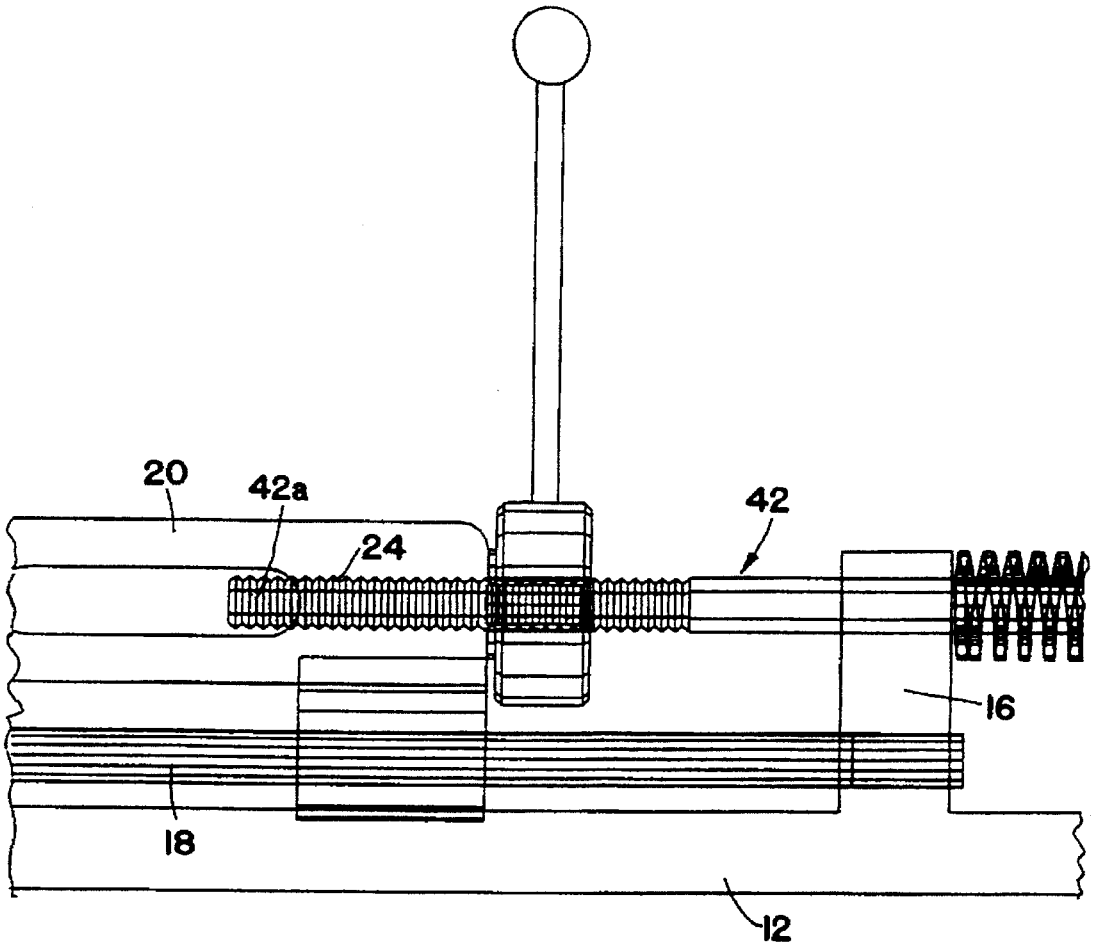
FIG. 3 is an enlarged side elevation view of the compensating prefeeder gate shown in FIG. 1, taken partly in section to detail a threaded connection between a second shaft and a body of the gate.

As seen in reference to FIGS. 1–3, a compensating prefeeder gate 10 is provided. Gate 10 includes an elongated arm 12, which extends outwardly at one point 12*a* along its length to form a first seat 14 and which extends outwardly at another point 12*b* along its length to form a second seat 16. The second seat 16 has a lower portion 16*a* and an upper portion 16*b*. Apertures are formed into first seat 14, lower portion 16*a*, and upper portion 16*b*, the first two the aforementioned apertures permitting a first shaft 18 to be received in the first seat 14 and in the lower portion 16*a* of the second seat 16. A plurality of nip rollers 17 are attached to an operative end of the arm 12.

A body 20 including ends 20*a* and 20*b* has a threaded bore 24 (FIG. 3) formed into end 20*a* and a frame attachment assembly 22 connected to end 20*b*. Frame attachment assembly 22 encompasses any suitable means for securing body 20 on a member but preferably comprises a clamp formed by a lower jaw 26 attached to body 20 at end 20*b* and an upper jaw 28 hinged by a pin 30 to the lower jaw 26. Jaws 26 & 28 collectively define an opening 29 with a cut-out section 31 which, as shown in FIG. 2, receives a machine frame member 32, shown in phantom lines. In this regard, assembly 22 is provided with means for adjusting the compressive force applied by the jaws 26 & 28 to the machine frame member 32. In the preferred embodiment, such means comprises clamp levers 34, 36, 38 and a clamp adjustment knob 40. For additional securement purposes, body 20 may also be provided with a slot 41.

A second shaft 42 interconnects arm 12 and body 20. Second shaft 42, which is provided with a first externally threaded end 42*a* (FIG. 3) and a second end 42*b* (FIG. 1), is journaled in the upper portion 16*b* of the second seat 16, and its first externally threaded end 42*a* is threadably received in the threaded bore 24. A nip adjustment knob 44 is received on the end 42*b* of the second shaft 42 and, in the preferred embodiment, a portion of the nip adjustment knob 44 extends downwardly to form an abutment 46 terminating at end 46*a*.

A spring 48 is coiled around the second shaft 42 intermediate the second seat 16 and the nip adjustment knob 44; more particularly, the spring 48 is positioned intermediate second seat 16 and abutment 46. Preferably, end 48*a* of spring 48 is spaced from end 46*a* of abutment 46 by a distance "x".

While second shaft 20 may be locked against rotation by any suitable means, the present invention for such a purpose contemplates a housing 50 secured to end 20*a* of body 20. A threaded housing bore is formed into the housing, and a locking lever 54 having a threaded end is threadably received in the housing bore to engage second shaft 42. In such a position, second shaft 42 is locked against rotation.

Slide bearings 56, 58 interconnect the body 20 and the first shaft 18, and they are adapted to slide along a length of the first shaft 18. These bearings are preferably welded to the bottom 20*c* of body 20, but they may be attached to body 20 by any other equivalent manner. As best seen in FIG. 2, arcuate cut-out sections 56*a*, 58*a* are respectively formed in bearings 56, 58 to receive the first shaft 18.

From the foregoing description, it will be appreciated that the arm 12, and thus the nip rollers 17, are displaceable with respect to the body 20 along axis 60 (FIG. 1) of arm 12. Thus, referring to FIG. 1, if a force pushes the nip rollers 17 rightwardly, the arm 12 moves in that direction relative to body 20, guided by the slide bearings 55 & 58 along first shaft 18 and by the second seat 16 along second shaft 42. If the arm 12 is pushed for a distance greater than "x", spring 48 becomes compressed between the second seat 16 and the abutment 46, thus biasing the arm 12 to the left. Thus, once arm 12 is oriented vertically, it and the rollers 17 collectively act as a floating gate with respect to articles which pass beneath the rollers 17.

In addition to the foregoing apparatus, the present invention contemplates a method of converting a stack of a plurality of articles transported on a conveying surface into a uniform shingled arrangement of articles, comprising the steps of providing a gate, the gate including an arm and a nip roller attached to a lower end of the arm, bringing a portion of the stack into contact with the arm, advancing a lowermost article in the stack to engage the nip roller, increasing a distance between the nip roller and the conveying surface, advancing a next-lowermost article in the stack to engage the nip roller, and further increasing said distance between said nip roller and said conveying surface. Advancement of the next-lowermost article is thereby retarded with respect to the lowermost article, thereby forming a shingled arrangement of the lowermost and next-lowermost articles as they are advanced beyond the gate.

FIGS. 4–7A illustrate the foregoing method steps, as well as other steps in the method contemplated by the present invention.

Figure 4:
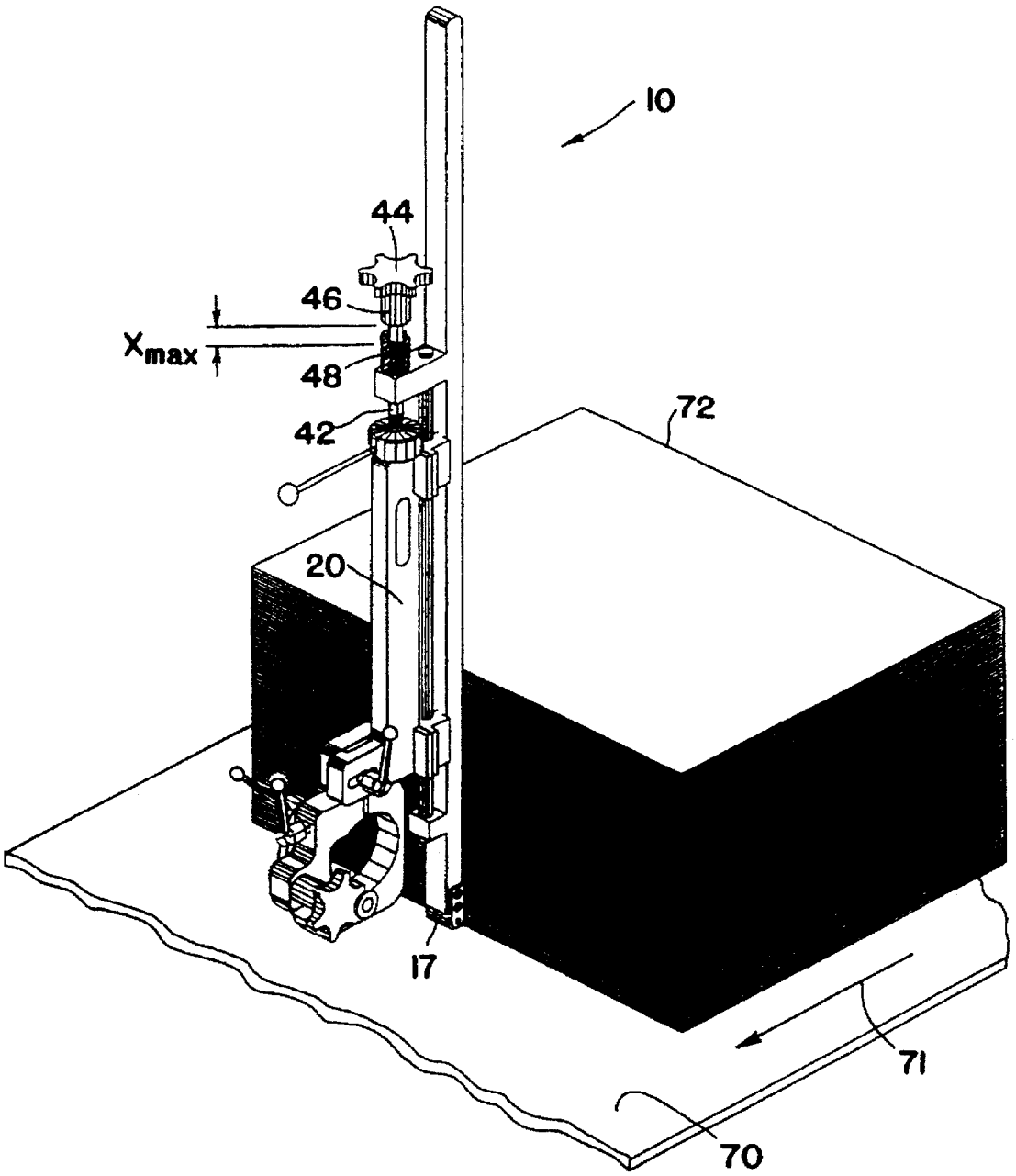
FIG. 4 is a perspective view of the compensating prefeeder gate, shown in FIGS. 1 & 2, positioned in relation to a stack of articles during an initial step of the method of the present invention.

Referring to FIG. 4, the prefeeder gate 10 is shown as being oriented vertically to accomplish its intended purpose. In the initial gate position shown, rollers 17 contact a conveying surface 70. A uniform stack 72 of articles is shown to have been conveyed by surface 70 in the direction of arrow 71 toward the prefeeder gate 10. Also characteristic of the position shown is the fact that the distance separating the end of spring 49 and abutment 46, is at its maximum and thus is denoted "$x_{max}$", since rollers 17 are in the lowermost downward position by virtue of contacting surface 70 Distance "$x_{max}$" constitutes a predetermined range through which the roller-arm assembly may move upwardly without compressing the spring 48. The magnitude of the maximum distance "$x_{max}$" is preset by turning adjustment knob 44 to increase or decrease the depth of penetration of the threaded end 42*a* (FIG. 3) of second shaft 42 into body 20. Thus, for example, decreasing such depth, e.g., tending to unscrew the second shaft 42 from the body 20, increases the magnitude of the maximum distance "$x_{max}$". Such adjustments may be made responsive to a number of factors, a principal factor being the desired height of the stack which is to be conveyed. Another factor is the coefficient of friction of the material comprising the articles in the stack 72.

Figure 4A:
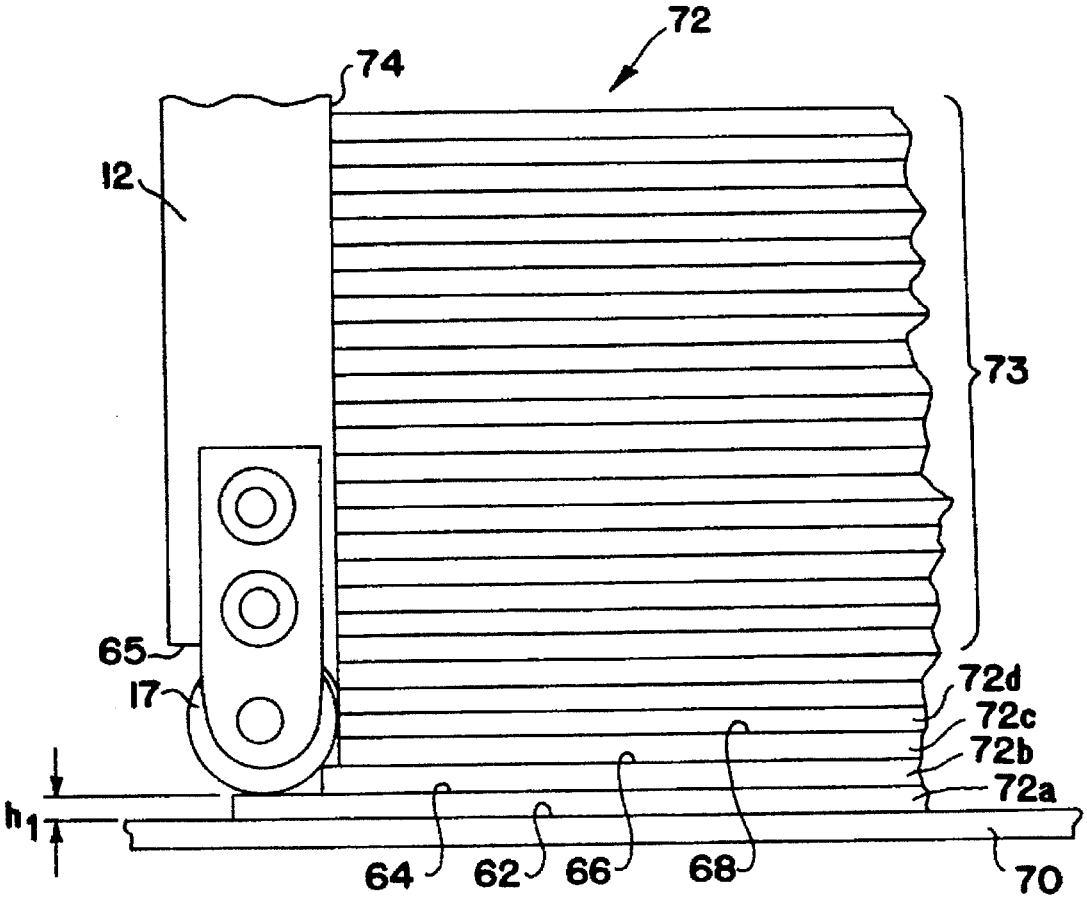
FIG. 4A is an enlarged side elevation view illustrating the interaction between the prefeeder gate and the stack of articles occurring during an early step in the method of the present invention.

FIG. 4A shows that a portion 73 of stack 72 has been brought into contact with an upstream side 74 of arm 12. As shown, portion 75 includes all articles which are at or above the elevation of lower end 65 of the arm 12 above conveying surface 70. A lowermost article 72*a* of stack 72 has been advanced to engage nip rollers 17, and such engagement is shown to have caused rollers 17 to disengage from conveying surface 70 and to rise above surface 70 by a distance $h_1$ equal to the thickness of lowermost article 72*a*. Additionally, a next-lowermost article 72b is shown as just contacting nip rollers 17 and having been slightly advanced with respect to the remaining articles in the stack 72.

Such movement of next-lowermost article 72b is caused by the frictional force acting at the interface 64 between articles 72a and 72b, which causes article 72b to advance along with article 72a. The magnitude of frictional force increases as the height of stack 72, and thus the weight of the articles superposed on next-lowermost article 72b, increases. Thus, the frictional force at the interface 62 between conveying surface 70 and lowermost article 72b is greater than that at any other plane passing through the stack 72, since more articles are superposed on lowermost article 72a than on any other article, and the respective frictional forces at interfaces 64, 66 (between articles 72b and 72c), and 68 (between articles 72c and 72d), and at the remaining interfaces between articles, progressively decrease.

Figure 5:
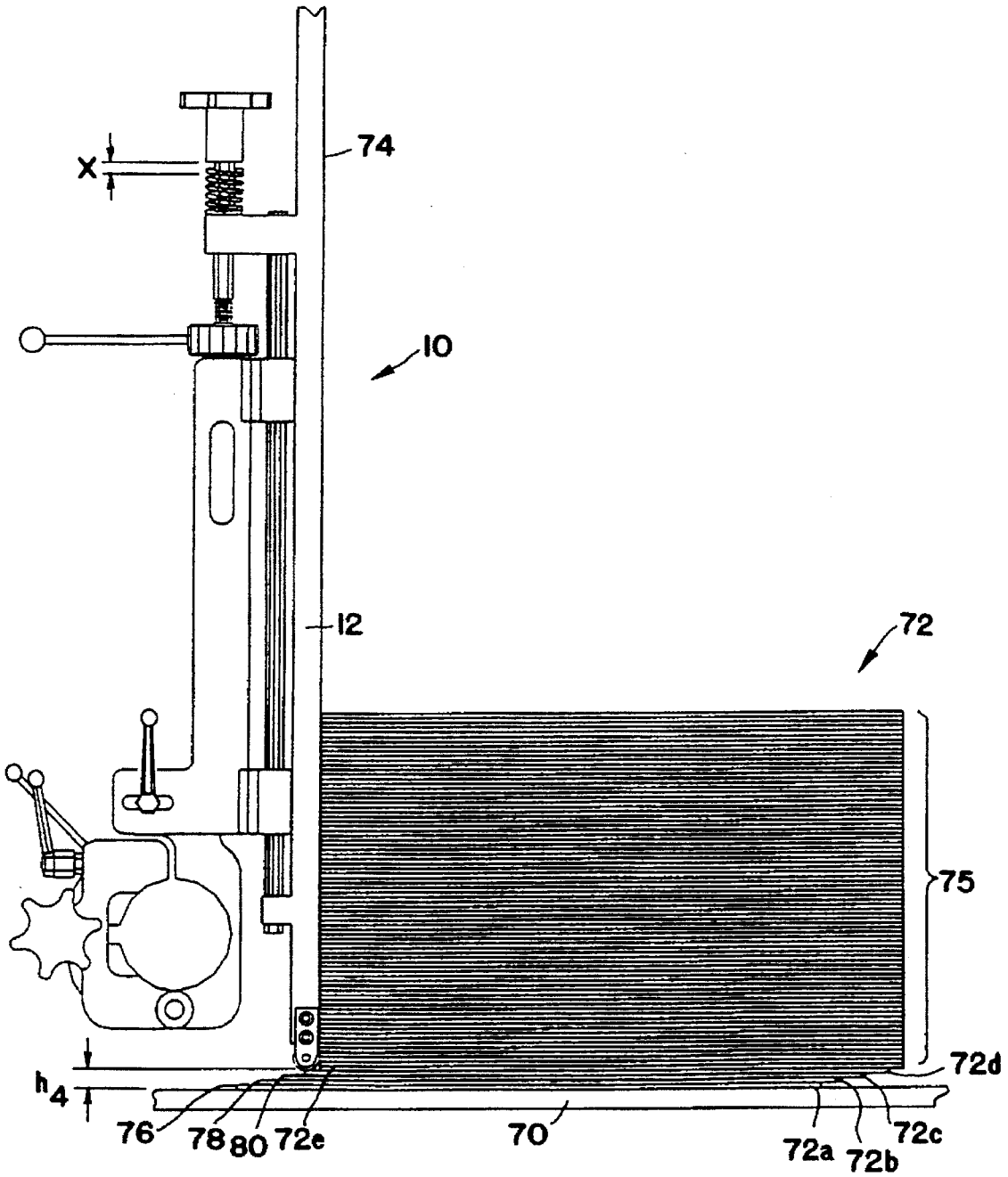
FIG. 5 is a side elevation view illustrating the interaction between the prefeeder gate and the stack of articles occurring during a subsequent step in the method of the present invention.

FIG. 5 illustrates subsequent steps in the shingling process. Specifically, nip rollers 17 are shown engaging fourth-to-lowermost article 72d, such engagement having caused the nip rollers 17 to further rise above conveying surface 70, whereby they are now spaced above surface 70 by a distance $h_4$ equal to the combined thickness of articles 72a, 72b, 72c, and 72d. Additionally, articles 72a, 72b, and 72c are shown to have assumed a uniform shingled arrangement, meaning that the distance between leading edges 76 and 78 of articles 72a and 72b, respectively, is the same as the distance between leading edges 78, 80 of articles 72b and 72c, respectively. Advancement of articles 72b and 72c has thereby been progressively retarded with respect to lowermost article 72a. FIG. 5 also shows an unshingled portion 75 of stack 72 ("unshingled" meaning no article protrudes forwardly of any other article), the lowermost article of which is article 72e. Finally with regard to FIG. 5, since the rollers 17 and arm 12 have moved upwardly, distance "x" is shown to have decreased from the maximum magnitude shown in FIG. 4.

Figure 6:
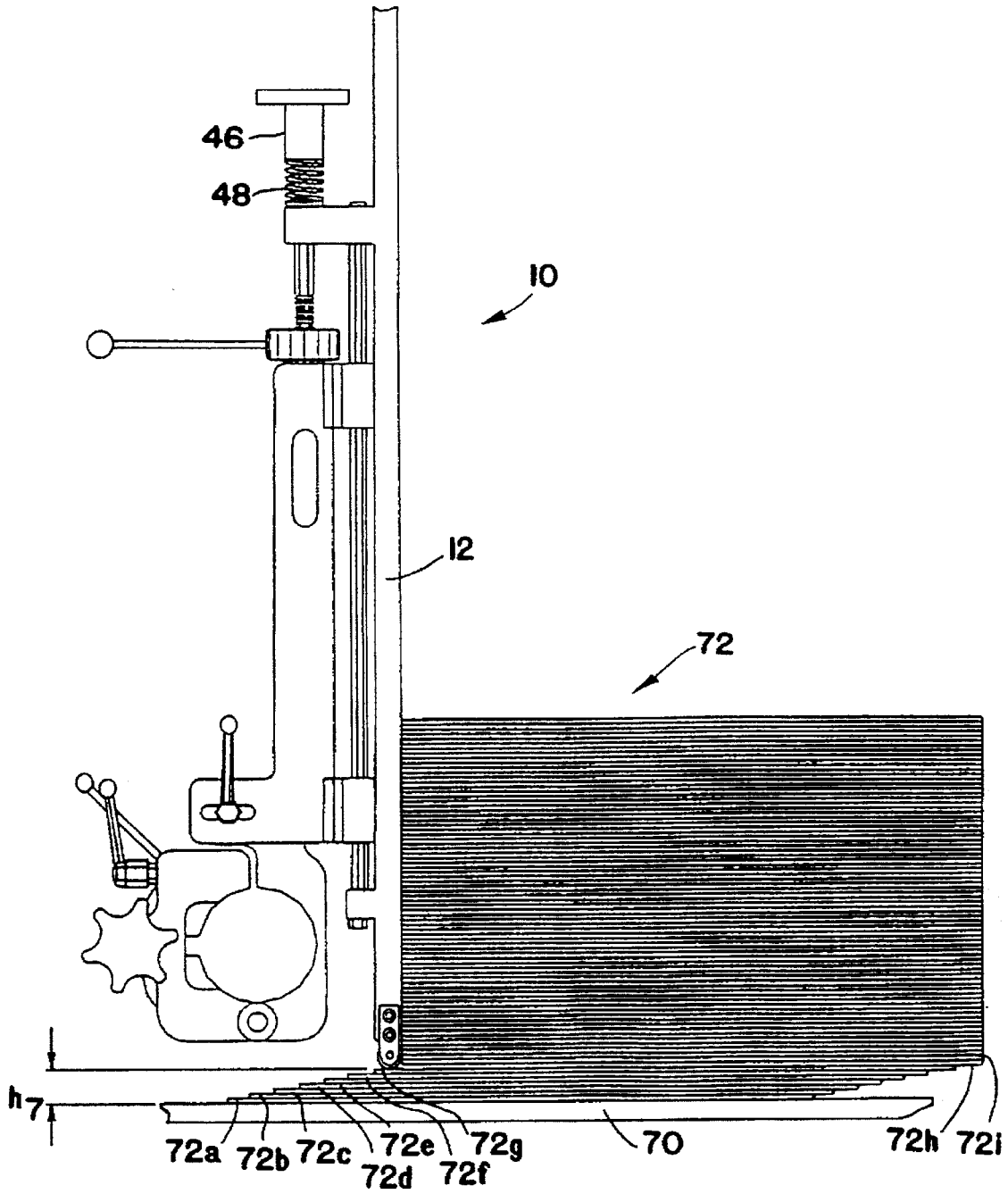
FIG. 6 is a side elevation view illustrating further interaction between the prefeeder gate and the stack of articles occurring during a further subsequent step in the method of the present invention.

FIG. 6 illustrates further shingling of articles. Here, additional articles 72d, 72e, 72f, and 72g have been arranged into a shingled arrangement along with articles 72a, 72b, 72c, and 72d. Articles 72h and 72i are the lowermost and next-lowermost unshingled articles, respectively. Rollers 17 have thereby risen a distance $h_7$, equal to the thickness of the seven shingled articles, above conveying surface 70.

Spring 48 is now shown in FIG. 6 as having been compressed; consequently, spring 48 is exerting a downward force, through arm 12 and thus through rollers 17, on articles passing beneath the rollers 17. This downward force supplements the weight of the gate-arm assembly which, when the rollers were moving through their predetermined range, e.g., the "x" distance was greater than zero as seen in previous figures, was the only downward force acting upon the articles. Thus, in previous figures, the total downward force acting on the articles was only the weight of the gate-arm assembly and was thus constant.

As shown in FIG. 6, the nip rollers 17 have moved at least one increment, here equal to the thickness of one article, beyond distance "$x_{max}$", since the spring is shown in a compressed state. For each such incremental movement, the spring is increasingly compressed, thus resulting in a progressively increasing total downward force exerted by nip rollers 17 on articles passing beneath the nip rollers 17.

Therefore, in view of the previous discussion regarding progressively decreasing frictional forces at article interfaces, once the nip rollers 17 have moved beyond the predetermined range "x", they exert a downward force inversely proportional to the frictional force between a lowermost unshingled article (such as 72h) and a next-lowermost unshingled article (such as 72i). In other words, as the frictional force between such articles decreases, the pressure exerted by nip rollers 17 on articles engaging them increases. The gate 10 thereby compensates for the decreased tendency of articles to go through the gate 10 as the interface frictional force decreases, thus maintaining a uniform shingled arrangement of articles contacted by the nip rollers 17.

Figure 6A:
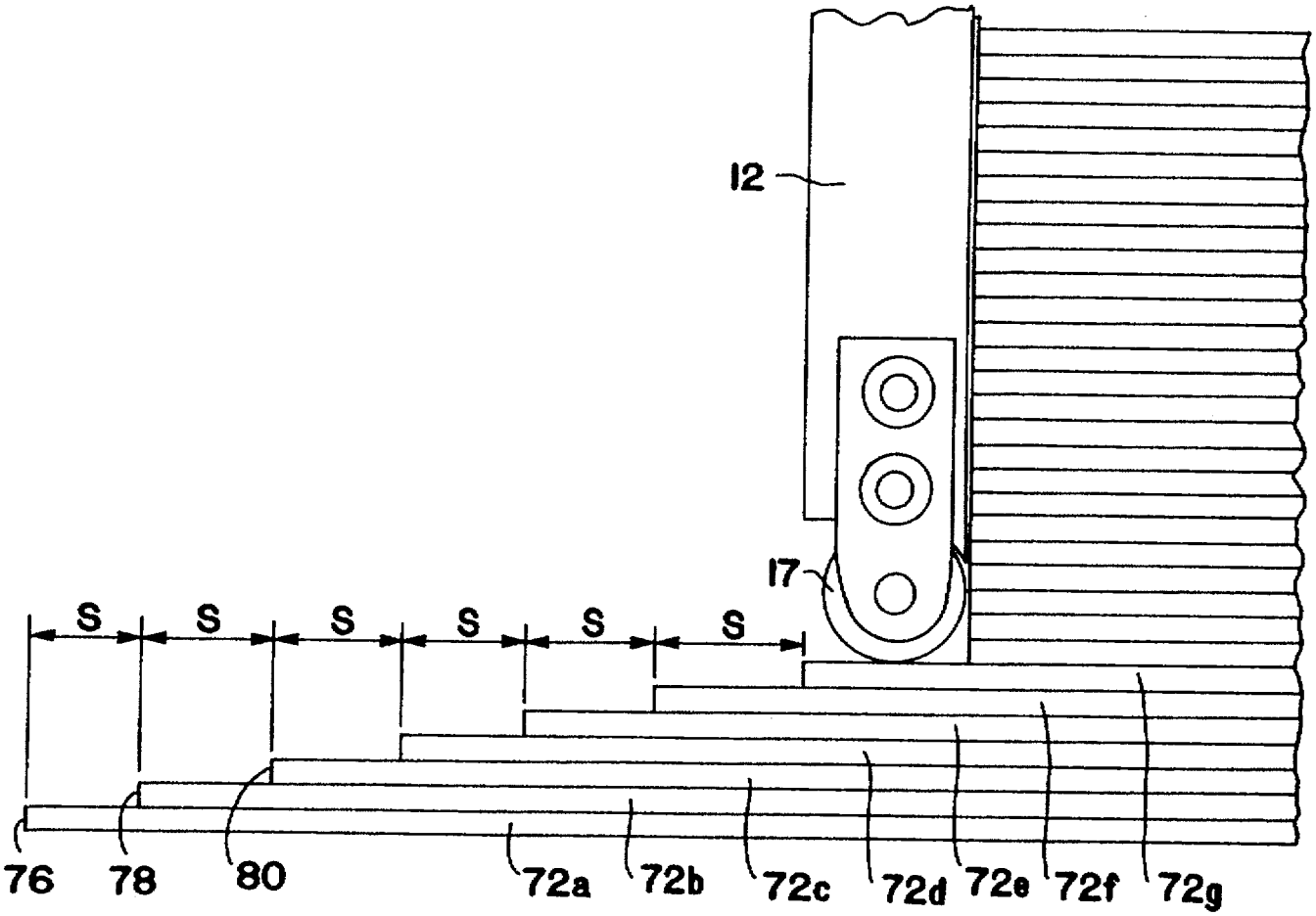
FIG. 6A is an enlarged portion of FIG. 6.

FIG. 6A more clearly illustrates the uniform nature of the resulting shingled arrangement, whereby distances "S" between successive leading edges of articles are all substantially equal to one another.

Figure 6B:
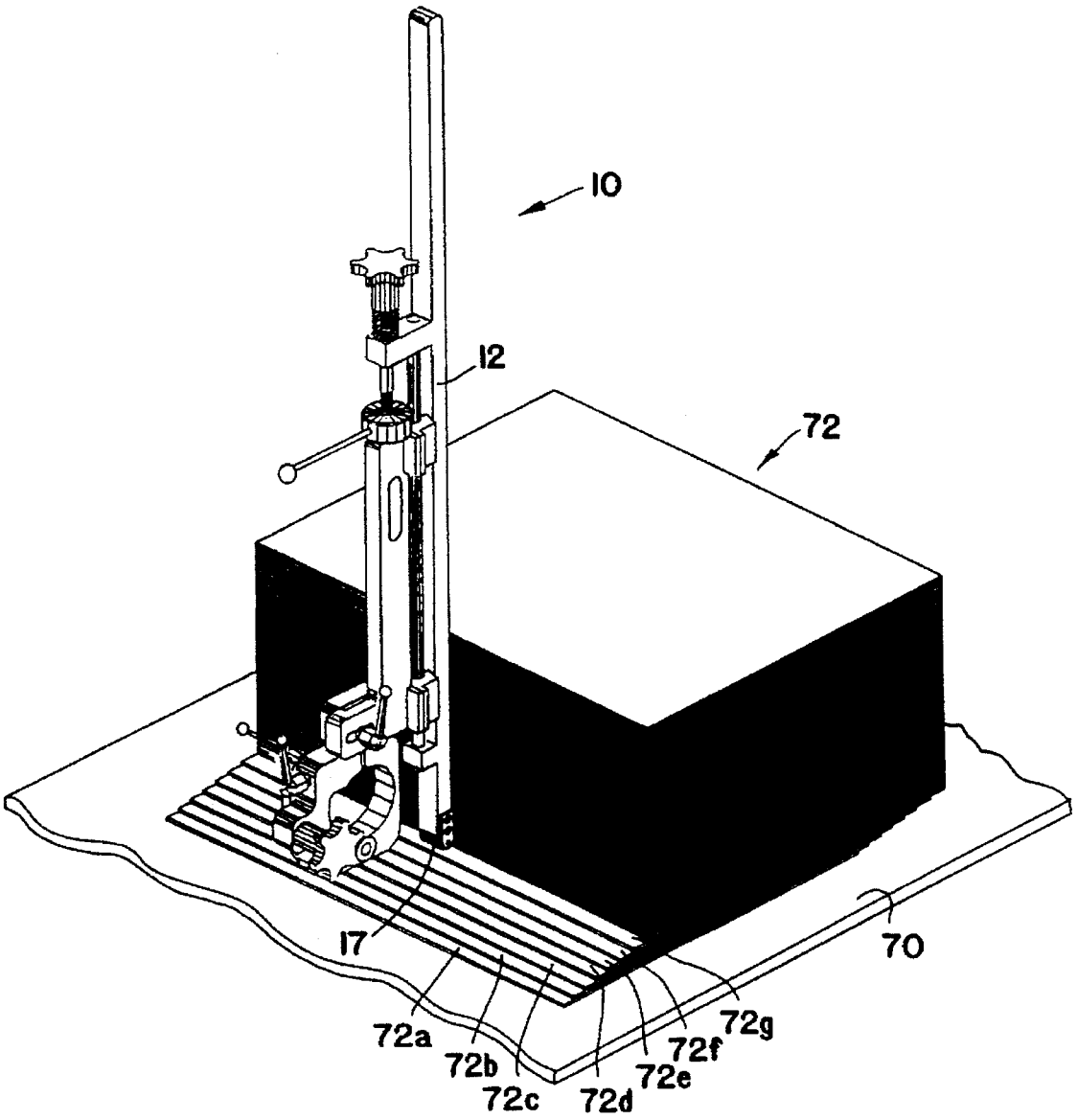
FIG. 6B is a perspective view illustrating the method step depicted in FIGS. 6 & 6A.

FIG. 6B provides a perspective view of the arrangement depicted in FIGS. 6A & 6B.

As the above description is merely exemplary in nature, being merely illustrative of the invention, many variations will become apparent to those of skill in the art. Such variations, however, are included within the spirit and scope of this invention as defined by the following appended claims.

That which is claimed:

1. A compensating prefeeder gate, comprising:

an elongated arm extending outwardly at one point along its length to form a first seat and extending outwardly at another point along its length to form a second seat, said second seat having a lower portion and an upper portion;

a first shaft received in said first seat and in said lower portion of said second seat;

a body having a threaded bore formed into one end of said body;

a second shaft having a first externally threaded end and a second end, said second shaft journaled in said upper portion of said second seat, said first externally threaded end being threadably received in said threaded bore;

a nip adjustment knob received on said second end of said second shaft;

a spring coiled around said second shaft intermediate said second seat and said nip adjustment knob;

a slide bearing interconnecting said body and said first shaft, said slide bearing being adapted to slide along a length of said first shaft; and a nip roller attached to an operative end of said arm;

whereby said nip roller is vertically displaceable with respect to said body responsive to thickness of conveyed articles contacted by said nip roller.

2. The compensating prefeeder gate set forth in claim 1 wherein an end of said spring opposite said second seat is spaced from said nip adjustment knob.

3. The compensating prefeeder gate set forth in claim 1 wherein:

a portion of said nip adjustment knob extends downwardly to form an abutment; and said spring is positioned intermediate said second seat and said abutment.

4. The compensating prefeeder gate set forth in claim 3 wherein an end of said spring opposite said second seat is spaced from said abutment.

5. The compensating prefeeder gate set forth in claim 1 further comprising means for selectively preventing rotation of said second shaft.

6. The compensating prefeeder gate set forth in claim 5 wherein said means for selectively preventing rotation of said second shaft comprises:

a housing attached to said another end of said body and encircling said second shaft intermediate said body and said second seat, said housing having an internally threaded bore; and a lever threadably received in said internally threaded bore of said housing.

7. The compensating prefeeder gate set forth in claim 1 further comprising a frame attachment assembly connected to another end of said body.

8. The compensating prefeeder gate set forth in claim 7 wherein said frame attachment assembly comprises:

a clamp formed by a lower jaw attached to said body at an end thereof opposite said threaded bore and an upper jaw hinged to said lower jaw; and means for adjusting compressive force applied by said upper and lower jaws to a machine frame member.

9. A method of converting a stack of a plurality of articles transported on a conveying surface into a uniform shingled arrangement of said plurality of articles, comprising the steps of:

providing a gate, said gate including an arm and a nip roller attached to a lower end of said arm;

bringing a portion of said stack into contact with said arm;

advancing a lowermost article in said stack to engage said nip roller;

increasing a distance between said nip roller and said conveying surface causing said nip roller to rise responsive to its engagement by said lowermost article;

causing said nip roller to exert a downward force on articles passing beneath said nip roller; and keeping said downward force constant throughout a predetermined range of movement of said nip roller;

causing said nip roller to rise in increments beyond said predetermined range;

progressively increasing said downward force for each increment moved by said nip roller beyond said predetermined range;

advancing a next-lowermost article in said stack to engage said nip roller; and further increasing said distance between said nip roller and said conveying surface causing said nip roller to further rise responsive to its engagement by said next-lowermost article;

whereby advancement of said next-lowermost article is retarded with respect to said lowermost article, thereby forming a shingled arrangement of said lowermost and next-lowermost articles as they are advanced beyond said gate.

10. A method of converting a stack of a plurality of articles transported on a conveying surface into a uniform shingled arrangement of said plurality of articles, comprising the steps of:

providing a compensating prefeeder gate comprising an elongated arm extending outwardly at one point along its length to form a first seat and extending outwardly at another point along its length to form a second seat, said second seat having a lower portion and an upper portion, a first shaft received in said first seat and in said lower portion of said second seat, a body having a threaded bore formed into one end of said body, a second shaft having a first externally threaded end and a second end, said second shaft journaled in said upper portion of said second seat, said first externally threaded end being threadably received in said threaded bore, a nip adjustment knob received on said second end of said second shaft, a spring coiled around said second shaft intermediate said second seat and said nip adjustment knob, a slide bearing interconnecting said body and said first shaft, said slide bearing being adapted to slide along a length of said first shaft, and a nip roller attached to an operative end of said arm;

bringing a portion of said stack into contact with said arm;

advancing a lowermost article in said stack to engage said nip roller;

increasing a distance between said nip roller and said conveying surface;

advancing a next-lowermost article in said stack to engage said nip roller; and further increasing said distance between said nip roller and said conveying surface;

whereby advancement of said next-lowermost article is retarded with respect to said lowermost article, thereby forming a shingled arrangement of said lowermost and next-lowermost articles as they are advanced beyond said prefeeder gate.

* * * * *